US010760869B2

(12) United States Patent
McPherson

(10) Patent No.: US 10,760,869 B2
(45) Date of Patent: Sep. 1, 2020

(54) ARCHERY BOW PULLEY ENGAGEMENT

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 16/222,826

(22) Filed: Dec. 17, 2018

(65) Prior Publication Data

US 2019/0186862 A1 Jun. 20, 2019

Related U.S. Application Data

(60) Provisional application No. 62/599,624, filed on Dec. 15, 2017.

(51) Int. Cl.
*F41B 5/10* (2006.01)
*F41B 5/14* (2006.01)

(52) U.S. Cl.
CPC ..... *F41B 5/105* (2013.01); *F41B 5/1426* (2013.01); *F41B 5/1411* (2013.01)

(58) Field of Classification Search
CPC ..... F41B 5/105; F41B 5/1426; F41B 5/1411
USPC ..... 124/25.6, 86, 90, 900
See application file for complete search history.

(56) References Cited

U.S. PATENT DOCUMENTS 4,202,316 A * 5/1980 Barna ..... F41B 5/10 124/25.6
4,353,346 A * 10/1982 Barna ..... F41B 5/10 124/23.1
5,322,049 A * 6/1994 Dunlap ..... D07B 1/18 124/90
5,598,831 A * 2/1997 Izuta ..... F41B 5/1411 124/90
5,715,804 A * 2/1998 Izuta ..... F41B 5/1411 124/90
5,884,617 A * 3/1999 Nelson ..... F41B 5/1411 124/90
6,039,035 A * 3/2000 McPherson ..... F41B 5/10 124/25.6
6,082,346 A * 7/2000 Andrews ..... F41B 5/10 124/25.6
8,881,714 B1 * 11/2014 Cooper ..... F41B 5/105 124/23.1
9,453,698 B1 * 9/2016 Grace ..... F41B 5/1411
9,964,379 B2 * 5/2018 Farren ..... F41B 5/1403
2001/0025636 A1 * 10/2001 Harwath ..... F41B 5/1426 124/89
2003/0168051 A1 * 9/2003 Andrews ..... F41B 5/10 124/25.6
2006/0011190 A1 * 1/2006 Andrews ..... F41B 5/10 124/89
2008/0092868 A1 * 4/2008 Silverson ..... F41B 5/14 124/86

(Continued)

*Primary Examiner* — Alexander R Niconovich

(57) ABSTRACT

In some embodiments, an archery bow comprises a riser, a first limb and a second limb. The first limb supports a first rotatable member, which comprises a cam. The second limb supports a second rotatable member, which comprises a pulley comprising a peripheral groove. A ring comprising an elastomeric material is positioned in the peripheral groove. A power cable is arranged to be taken up on the cam as the bow is drawn. A string segment is arranged to wrap around the pulley. The string segment contacts the ring.

18 Claims, 3 Drawing Sheets

(56) References Cited

U.S. PATENT DOCUMENTS

| | | | | |
|---|---|---|---|---|
| 2009/0272369 | A1* | 11/2009 | Konczal | F41B 5/105<br>124/25.6 |
| 2012/0272939 | A1* | 11/2012 | Grace, Jr. | F41B 5/10<br>124/25.6 |
| 2014/0083401 | A1* | 3/2014 | Armstrong | F41B 5/105<br>124/25.6 |
| 2014/0261366 | A1* | 9/2014 | McPherson | D02G 3/444<br>124/90 |
| 2017/0097206 | A1* | 4/2017 | Hughes | F41B 5/10 |

* cited by examiner

ARCHERY BOW PULLEY ENGAGEMENT

CROSS-REFERENCE TO RELATED APPLICATIONS

This application claims the benefit of U.S. Patent Application No. 62/599,624, filed Dec. 15, 2017, the entire content of which is hereby incorporated herein by reference.

BACKGROUND OF THE INVENTION

This invention relates generally to archery bows and more specifically to compound archery bows having at least one rotating cam assembly. Some compound archery bows include a rotating cam assembly and a rotating pulley, and a section of a bowstring wraps around the pulley. An example of such a bow is disclosed in U.S. Pat. No. 5,368,006, the entire content of which is hereby incorporated herein by reference.

There remains a need for novel compound bow structures that provide improvements in efficiency over prior bows.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a riser, a first limb and a second limb. The first limb supports a first rotatable member, which comprises a cam. The second limb supports a second rotatable member, which comprises a pulley comprising a peripheral groove. A ring comprising an elastomeric material is positioned in the peripheral groove. A power cable is arranged to be taken up on the cam as the bow is drawn. A string segment is arranged to wrap around the pulley. The string segment contacts the ring.

In some embodiments, an archery bow comprises a riser, a first limb and a second limb. The first limb supports a first rotatable member, which comprises a cam. The second limb supports a second rotatable member, which comprises a pulley comprising a peripheral groove comprising surface texturing. A power cable is arranged to be taken up on the cam as the bow is drawn. A string segment is arranged to wrap around the pulley. A portion of the string segment is oriented in the peripheral groove.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
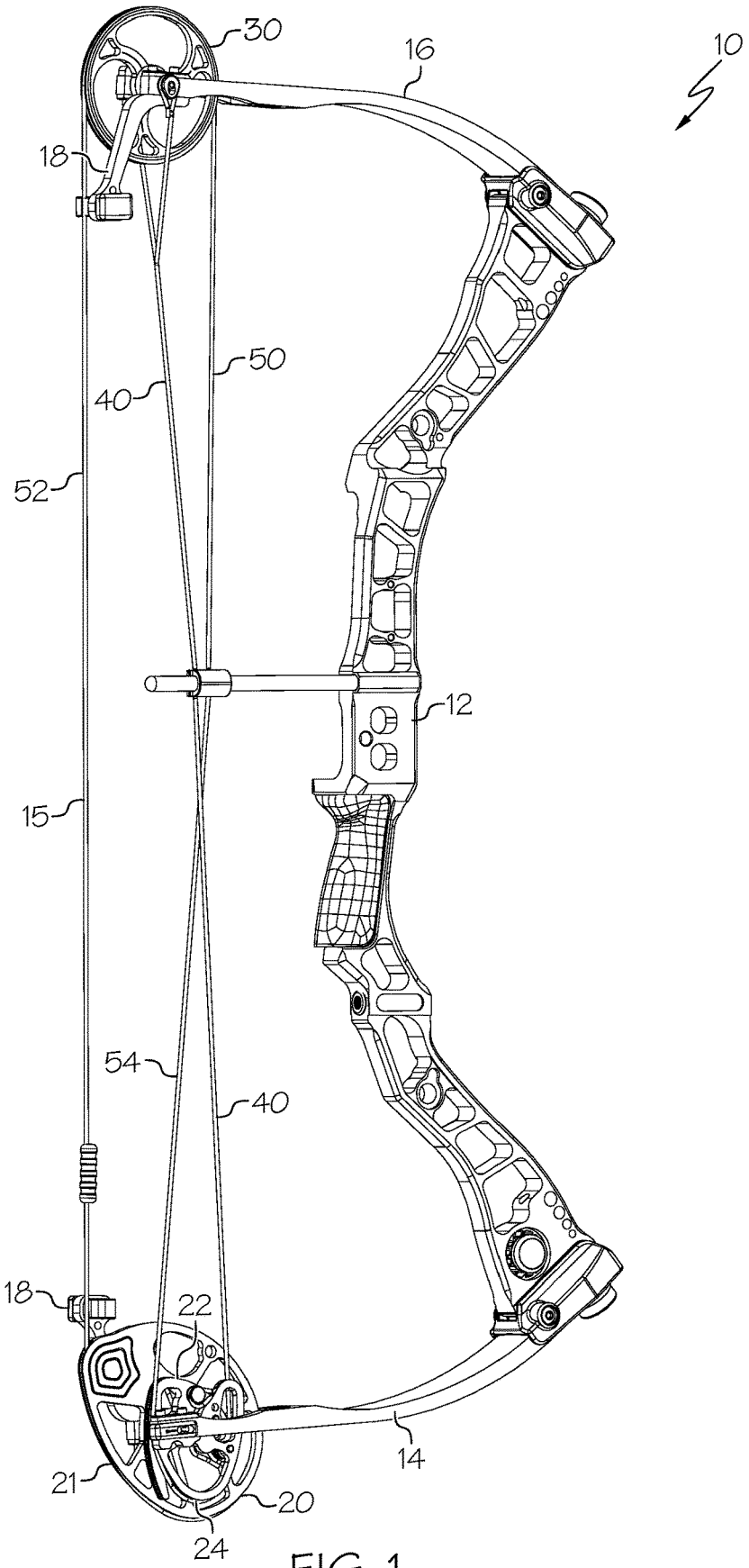
FIG. 1 shows an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10. In some embodiments, a bow 10 comprises a riser 12, a first limb 14 and a second limb 16. The first limb 14 supports a first rotatable member 20 and the second limb 16 supports a second rotatable member 30.

The bow 10 shown in FIG. 1 comprises a single-cam bow, for example as disclosed in U.S. Pat. No. 5,368,006. In some embodiments, the second rotatable member 30 comprises a pulley having a constant radius. In some embodiments, the bow 10 comprises a power cable 40 and the first rotatable member 20 comprises a cam track 22 arranged to take up the power cable 40 as the bow 10 is drawn. In some embodiments, the bow 10 comprises a string segment 50 that extends from the first rotatable member 20 to the second rotatable member 30, wraps around the second rotatable member 30 and extends back to the first rotatable member 20. The string segment 50 comprises a bowstring portion 52 and a control cable portion 54. Desirably, the bowstring portion 52 comprises a nocking point 15. In some embodiments, the first rotatable member 20 comprises a bowstring track 21 and a secondary feed out track 24. As the bow 10 is drawn, the bowstring track 21 feeds out the bowstring portion 52 of the string segment 50, and the secondary feed out track 24 feeds out the control cable portion 54 of the string segment 50. The control cable portion 54 extends to the second rotatable member 30 and becomes a second end of the bowstring portion 52 as it passes over the second rotatable member 30.

In some embodiments, a bow 10 comprises string suppressors 18, for example as taught in U.S. RE42842.

It has been discovered that the second rotatable member 30 does not necessarily remain engaged with the string segment 50 as the bow 10 is fired. For example, the string segment 50 can slip with respect to the second rotatable member 30. For example, a reference marking can be placed on the second rotatable member 30 and aligned with a reference marking on the string segment 50. The bow 10 can be drawn and fired, and the reference markings can come to rest in a non-aligned orientation. A traditional understanding of bow dynamics tends to suggest that slipping can provide greater arrow speed, as energy that is not used to spin the second rotatable member 30 could reach the arrow. However, it has been discovered that increasing the engagement between the string segment 50 and the second rotatable member 30 can result in higher arrow speeds.

The engagement between the string segment 50 and the rotatable member 30 can be increased in any suitable manner. In some embodiments, higher friction materials can be used—for example on the rotatable member 30, on the string segment 50, or both. In some embodiments, surface texturing can be applied to either or both of the rotatable member 30 and/or the string segment 50.

Figure 2:
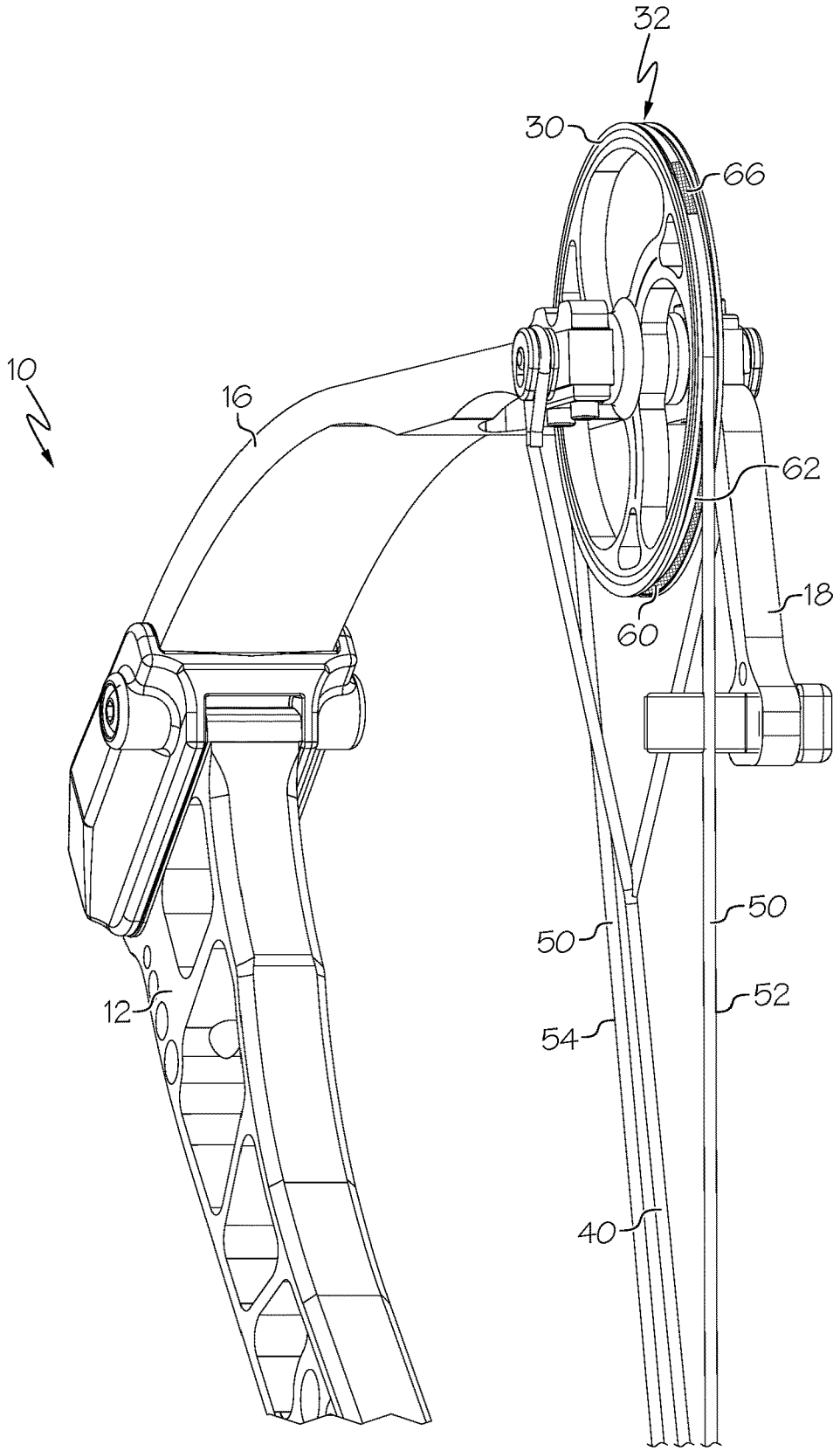
FIG. 2 shows a more detailed view of a portion of the bow shown in FIG. 1.
Figure 3:
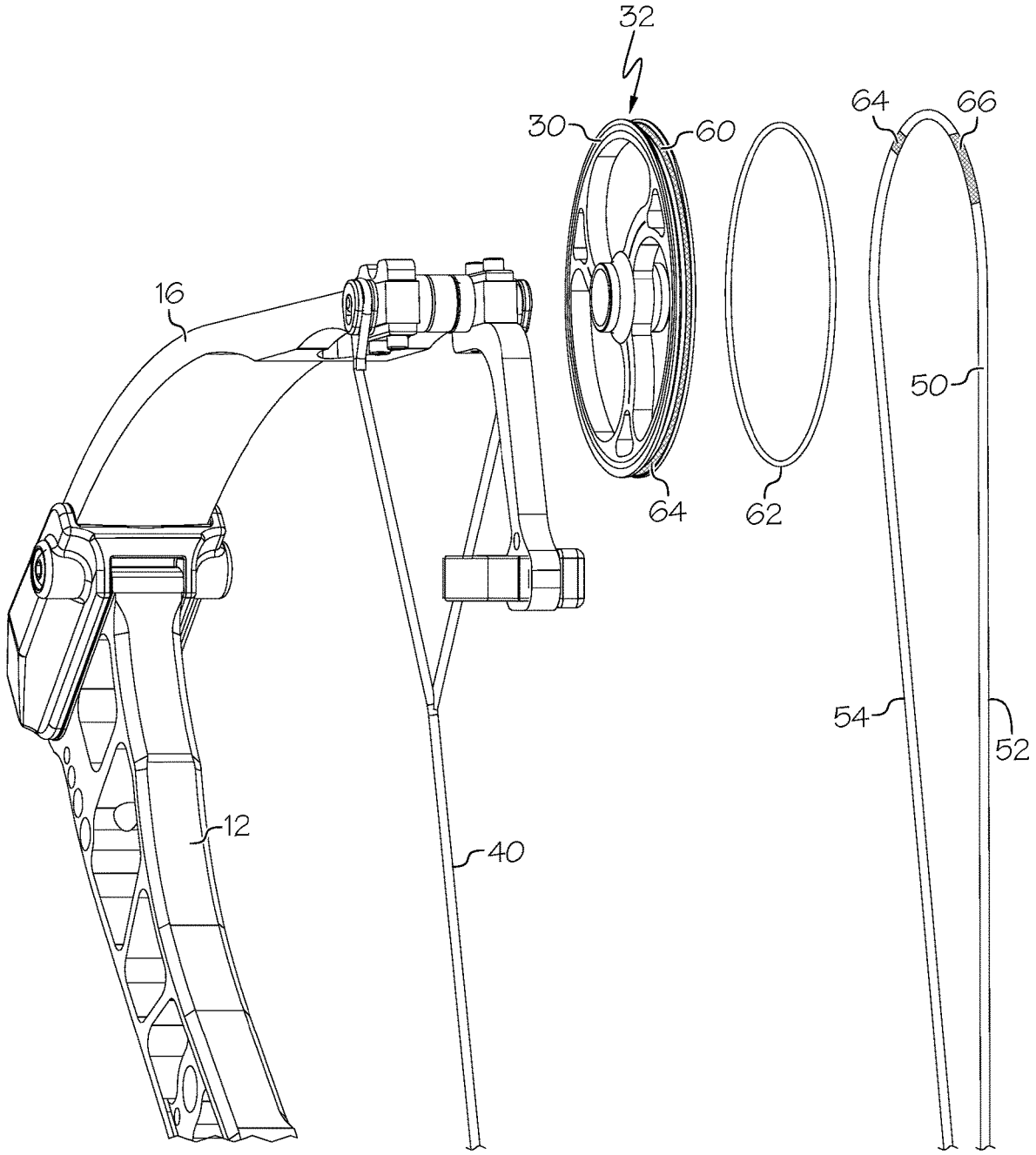
FIG. 3 shows an exploded view of the bow of FIG. 2.

FIG. 2 shows a more detailed view of a portion of the bow 10 of FIG. 1, and FIG. 3 shows the structure of FIG. 2 in an exploded view.

In some embodiments, the rotatable member 30 comprises surface texturing 60 such as knurling. Surface texturing 60 can be applied in any suitable manner. Surface texturing 60 can comprise protrusions and recesses formed in a surface of the rotatable member 30, which can increase engagement between the rotatable member 30 and the string segment 50. In some embodiments, knurling comprises a plurality of X-shaped grooves. In some embodiments, X-shaped grooves overlap.

In some embodiments, a string track 32 comprises a recess formed in the rotatable member 30. In some embodiments, a surface of the string track 32 comprises surface texturing.

In some embodiments, a high friction material can be applied to the rotatable member 30. In some embodiments, an elastomeric coating is applied to at least the string track 32 of the rotatable member 30. In some embodiments, a rubber, elastomeric material, silicone material, or other suitable material can be applied to the string track 32, which comprises a higher coefficient of friction than the material used to form the rotatable member 30.

In some embodiments, a high friction material can be attached to the rotatable member 30 and positioned in the string track 32. In some embodiments, an abrasive material can be attached to the rotatable member 30 and positioned in the string track 32. In some embodiments, a ring 62 comprising an elastomeric material and/or rubber is positioned in the string track 32 of the rotatable member 30. A ring 62 can comprise any suitable material and desirably comprises a material having a higher coefficient of friction than the material used to form the rotatable member 30. In some embodiments, a ring 62 comprises an O-ring, for example having a circular cross-section. In some embodiments, a ring 62 comprises a rubber band. In some embodiments, a ring 62 comprises a non-circular cross-sectional shape.

In some embodiments, an adhesive 64 can be applied to either or both of the string track 32 and/or the string segment 50.

In some embodiments, the string segment 50 comprises a high friction material. In some embodiments, the string segment 50 comprises an abrasive material. In some embodiments, the string segment 50 comprises Kevlar, which tends to have a coefficient of friction several times greater than a coefficient of friction of common polymeric materials that are used to make bowstrings.

In some embodiments, the string segment 50 comprises a serving 66 comprising a high friction material such as Kevlar, an elastomeric material, etc. In some embodiments, a serving 66 comprises a helical wrapping of material around the string segment 50. A serving can extend for any suitable length portion of the string segment 66. In some embodiments, several short portions of serving 66 are spaced apart along a length of the string segment 50.

In some embodiments, a higher friction tube of material can be provided around the string segment 50. For example, in some embodiments, a rubber or elastomeric shrink tubing can be attached to the string segment 50.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:

a riser;

a first limb supporting a first rotatable member, the first rotatable member comprising a cam;

a second limb supporting a second rotatable member, the second rotatable member comprising a pulley comprising a peripheral groove;

a ring comprising an elastomeric material, the ring comprising an O-ring comprising a circular cross-sectional shape, the ring positioned in the peripheral groove;

a power cable arranged to be taken up on the cam as the bow is drawn; and a string segment arranged to wrap around the pulley, the string segment contacting the ring;

wherein a thickness of the elastomeric material is less than a diameter of the string segment.

2. The archery bow of claim 1, the elastomeric material comprising a higher coefficient of friction than a material that forms the string segment.

3. The archery bow of claim 1, the elastomeric material comprising a higher coefficient of friction than a material that forms the second rotatable member.

4. The archery bow of claim 1, the string segment comprising a polymeric material and a serving material, the serving material comprising a higher coefficient of friction than the polymeric material.

5. The archery bow of claim 4, the serving material comprising Kevlar.

6. The archery bow of claim 1, the ring comprising a rubber band.

7. An archery bow comprising:

a riser;

a first limb supporting a first rotatable member, the first rotatable member comprising a cam;

a second limb supporting a second rotatable member, the second rotatable member comprising a pulley comprising a peripheral groove;

a ring comprising an elastomeric material, the ring positioned in the peripheral groove;

a power cable arranged to be taken up on the cam as the bow is drawn; and a string segment arranged to wrap around the pulley, the string segment contacting the ring;

the peripheral groove comprising surface texturing.

8. The archery bow of claim 7, the surface texturing comprising knurling.

9. An archery bow comprising:

a riser;

a first limb supporting a first rotatable member, the first rotatable member comprising a cam;

a second limb supporting a second rotatable member, the second rotatable member comprising a pulley comprising a peripheral groove, the peripheral groove comprising surface texturing, the surface texturing comprising knurling;

a power cable arranged to be taken up on the cam as the bow is drawn; and a string segment arranged to wrap around the pulley, a portion of the string segment oriented in the peripheral groove.

10. The archery bow of claim 9, the string segment comprising a polymeric material and a serving material, the serving material comprising a higher coefficient of friction than the polymeric material.

11. The archery bow of claim 10, the serving material comprising Kevlar.

12. The archery bow of claim 9, the peripheral groove comprising an elastomeric material.

13. The archery bow of claim 12, the elastomeric material comprising a ring of elastomeric material, the ring of elastomeric material oriented in the peripheral groove.

14. The archery bow of claim 13, the ring comprising an O-ring.

15. The archery bow of claim 13, the ring comprising a rubber band.

16. The archery bow of claim 9, the second rotatable member comprising an elastomeric coating.

17. The archery bow of claim 9, the knurling comprising a plurality of X-shaped grooves.

18. The archery bow of claim 17, wherein adjacent X-shaped grooves overlap.

* * * * *